US006719678B1

(12) United States Patent
Stern

(10) Patent No.: US 6,719,678 B1
(45) Date of Patent: Apr. 13, 2004

(54) RECLOSEABLE RETORT POUCH

(75) Inventor: Ran Stern, Kibbutz Sde Yoav (IL)

(73) Assignee: C.L.P Industries Ltd., Kibbuz Negba (IL)

( * ) Notice: Subject to any disclaimer, the term of this patent is extended or adjusted under 35 U.S.C. 154(b) by 0 days.

(21) Appl. No.: 09/514,840

(22) Filed: Feb. 28, 2000

(51) Int. Cl.[7] ..... B31B 1/90
(52) U.S. Cl. ..... 493/212; 493/213
(58) Field of Search ..... 493/212, 213, 493/214, 927; 53/133.4, 139.2; 383/43, 45, 63

(56) References Cited

U.S. PATENT DOCUMENTS

| | | | | |
|---|---|---|---|---|
| 3,790,744 | A | * | 2/1974 | Bowen |
| 4,762,514 | A | | 8/1988 | Yoshida |
| 5,001,325 | A | | 3/1991 | Huizinga et al. |
| 5,010,231 | A | | 4/1991 | Huizinga et al. |
| 5,059,036 | A | | 10/1991 | Richardson et al. |
| 5,147,272 | A | | 9/1992 | Richardson et al. |
| 5,158,499 | A | * | 10/1992 | Guckenberger |
| 5,254,073 | A | | 10/1993 | Richardson et al. |
| 5,542,902 | A | * | 8/1996 | Richison et al. |
| 5,630,308 | A | * | 5/1997 | Guckenberger |
| 5,660,479 | A | * | 8/1997 | May et al. |
| 5,937,617 | A | * | 8/1999 | Yeager |
| 6,007,246 | A | * | 12/1999 | Kinigakis et al. |
| 6,076,664 | A | * | 6/2000 | Yeager |
| 6,126,975 | A | * | 10/2000 | Archibald et al. |

FOREIGN PATENT DOCUMENTS

| | | |
|---|---|---|
| EP | 0 345930 B1 | 12/1989 |
| EP | 0 473 517 A2 | 3/1992 |
| EP | 0 597 650 B1 | 5/1994 |
| EP | 0 731 034 B1 | 9/1996 |
| EP | 0 731 035 A3 | 9/1996 |
| JP | 9301446 A | 11/1997 |

OTHER PUBLICATIONS

Santacruz, Jorge Pasquel, "Standup Pouches", Seminario Presentado para la Industria de Alimentos, 1998, pp. 1–15.
"general Catalog", Totani Corporation.

* cited by examiner

*Primary Examiner*—Eugene Kim

(57) ABSTRACT

There is provided machinery and a method for manufacturing a stand-up retort pouch. The pouch has at least two opposed sheets of retort-resistant laminate material and a bottom gusset. It further has a recloseable fastener between the opposing sheet surfaces thereof, the recloseable fastener extending from a first side outer edge to an opposing second side outer edge and adjacent to at least one outer edge. The sheet surfaces are each scored with a laser score line. The laser score lines are in registration with one another and parallel with the recloseable fastener. The sheets are heat-sealed together along the top and side outer edges thereof and together with the gusset at a bottom edge thereof. The disclosed pouch is burst-resistant when sealed after first being filled with wet contents and subsequently being subjected to retort processing.

8 Claims, 7 Drawing Sheets

FIG. 11
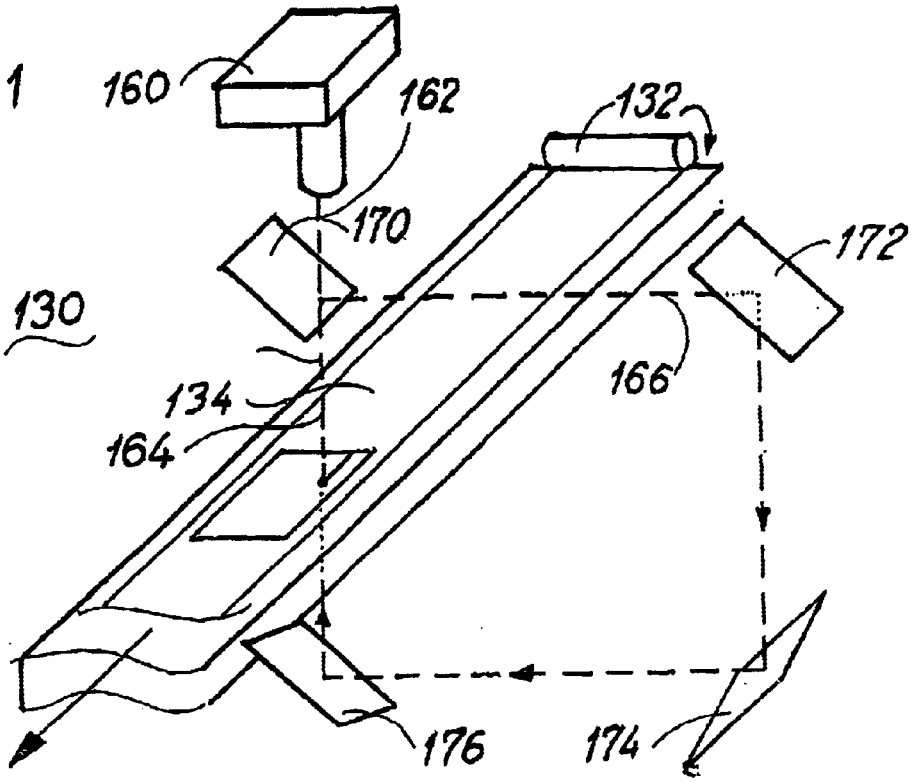
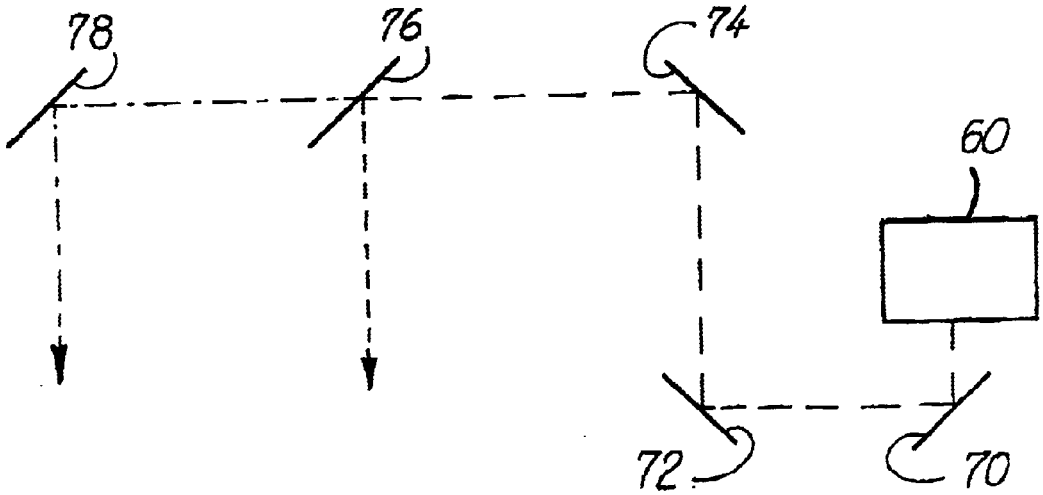
FIG 10

RECLOSEABLE RETORT POUCH

FIELD AND BACKGROUND OF THE INVENTION

The present invention generally relates to retort pouches for materials, such as food products. More particularly, the present invention relates to a retort pouch which is suitable for wet food and which can be easily opened and reclosed.

Closable pouches having an integral zipper or fastener are well known in the art of packaging dry foods. These pouches are often rectangular, made of a web material, and have heat-sealed portions at both side and bottom edge portions. A top opening portion is often provided with means for repetitively opening and reclosing the opening, such as a zipper fastener fastened to the inner surfaces thereof, and extending from one side edge to the opposite side edge. The top opening portion is usually heat-sealed until the product is to be used. In order to open the pouch, the pouch is manually cut between the top heat-sealed portion and the zipper portion, and the top edge is removed. If any product remains in the pouch after being opened, the pouch can be reclosed and reopened by means of a zipper comprising a ridge and trough arranged in registration on the inner surface of the front and back panels of the pouch.

One pouch manufacturing technique is described in U.S. Pat. No. 5,542,902 to Richison et al. In this process, a single web is divided into two portions, with one portion being placed beneath the other. A zipper closure and a base gusset are oriented between the two portions, and then front and back panels of the pouch (formed of the two slit portions of the web) are heat-sealed to one another along their edges to form the pouch.

However, when pouches are to be used to hold retort food, an oxygen blocking capability and adequate strength at the high sterilization temperatures are required. It has been disclosed that these goals am attainable by forming the wall portions of the pouch from a laminated film consisting of four layers, the outermost of which is polyester (hereinafter "PET"), followed by aluminum foil (hereinafter "Al"), then BiOriented Nylon (hereinafter referred to as "BONyl") and the innermost of a non-oriented or cast polypropylene film (hereinafter "CPP"). It is also known to provide a laminated film consisting of the same four layers of material in the following arrangement: outermost is PET, then BONyl, then Al, and the innermost layer of CPP. The foil layer provides a barrier to air, humidity and light and therefore should preferably be preserved intact until the product reaches the consumer.

The feature of stand-up capability has been achieved by adding a separate gusset between the bottom parts of the two webs, or by adding a flap to the bottom of a single sheet which is intended to be folded in two, thus forming two leaves with the flap as a gusset serving as a base of a stand-up pouch. The aforementioned laminated films have sufficient strength so that pouches made from them withstand the high temperatures and pressures generated during the retort process without bursting and releasing their contents or otherwise losing their hermetic sealing and loss of the required food sterility. This means, however, that great force is required in order to tear them, so as to open the pouch in the first place. Thus, generally a knife or scissors are required in order to cut the laminated film.

To address this problem of difficulty of opening, it has been suggested to utilize a tape formed of an oriented plastics material at a position between the top edge and the zipper. The oriented tape is arranged for easy cutting in one direction. However, placing such tapes on the pouch reduces the efficiency of the pouch producing process, and results in higher costs per pouch.

It is also known, for example from U.S. Pat. No. 3,790,744 to Bowen, to utilize laser energy to provide a weakened line in the laminate web material, so as to form a tear line in the laminate, and from EP 0 473 517 to American National Can Company to provide laser scoring in two close parallel lines across a non-reclosable laminate pouch to create a tear line. Generally, the laser scoring is performed on the individual webs while they are in the slitter, before assembly of the pouch. When it is time to assemble the pouch, there is often a problem of ensuring that the score lines on the front and back panels of the pouch are in registration with one another, which is required in order to obtain good tear performance.

However, as described by Richison, it is extremely difficult to ensure the precision of registration required for a good tear. The teachings of EP 0 473 517 attempt to compensate for this lack of precision by providing two or three close parallel laser scored lines, about ⅛" to 1/16" apart on the same surface. While this might address the tear performance caused by imprecisely aligned webs, it requires the use of two or three times as many lasers, thereby greatly increasing the expense of the production process. In addition, the disclosed method of scoring of two lines so close to one another can detrimentally affect the mechanical properties of the pouch, thereby affecting its suitability for use with wet materials in a retort process, due to the extreme conditions generated by the process.

An alternative method of facilitating the removal of the top portion of the pouch is disclosed in EP 0 345 930 to Kabushiki Kalsha Hosakawa Yoko where it is taught to subject the inner layer of the laminate to surface roughening treatment by an abrasive roller for forming a surface roughened zone of small width. The mechanical strength of the laminate in this surface roughened zone is reduced, so as to facilitate cutting of the sheet therealong. In theory, this treatment is effected only on the internal cast polypropylene layer or on the outer polyester layer. In practice, this is problematic since it applies an abrasive mechanical means to the laminate. Since it is very difficult to control the depth of the recesses cut by the abrasive, this can lead to the creation of pinholes in the adjacent air impermeable layer, thereby permitting air and moisture to contact the contents of the pouch.

Known stand-up pouches, which are intended for retort, are mostly suitable only for use with dry contents (i.e. having moisture content significantly below 2%, usually as little as 1.2% or less). Examples of dry foods are dry dog food, dried soup mixes, dried gravy mixes, dried, cake mixes, dried pudding mixes. This is so because the use of flexible retort packages (instead of conventional cans) for liquid or partially liquid foods (for example having moisture content greater than 2%), such as soup, gravy, purse, sauces, toppings, condiments, etc., poses particular challenges. Usually, food material is packed in a retort pouch and then transferred to an autoclave where it undergoes a sterilization process at high temperatures, above 121° C. and pressure of about 2 atm. The volume of water increases many hundreds of times when it turns into steam and the energy released by the steam is much higher than that released by the water at 100° C. Thus, in packages with liquid or wet products, the pressure and steam temperatures produced inside the package even by a small quantity of evaporated water are much higher than with dry foods, dramatically increasing the resistance requirements of the components used, including the different webs, adhesives and dyes. For this reason, at present, most of the canning industry utilizes metal cans, whose resistance at high temperatures and pressures are greater than those of flexible, plastic webs. During the retort process with flexible packages, it is necessary to work with special autoclaves wherein it is possible to apply opposing, external, pressure of about 2 atm, as well as tight control over the cooling phase, in order to prevent the packages from bursting.

The particular sensitivity of the stand-up pouch to the pressures created during the retort process, as compared with other packages, arises from the complicated make-up of the pouch, and the various heat-seals required to assemble the base of the pouch. The pouch may include a plurality of overlapping webs, requiring heat-sealing through multiple layers. These points are particularly vulnerable to bursting under pressure during the retort process.

Thus, the high requirements for these plastic webs have prevented the incorporation of fastener means for repetitively opening and reclosing of such packages which, in themselves, reduce the resistance of pouches to the retort process. For example, the use of a zipper-type fastener is known to weaken the heat-seals on the side edges of the pouch. This problem was addressed recently at an international seminar titled "Stand up Pouches", presented by La industria de Allmentos, held in Mexico D.F. on Nov. 4, 1998, in a lecture by Ing. Jorge Pasquel Santacruz, in which it was explicitly stated that, "it is important to know that when one decides to use a zipper like any other feature, it is not possible for the pouch to be sterilized by the method of retort."

Accordingly, there is a long-felt need for easy to open, reclosable, stand-up pouches useful for wet retort, and it would be very desirable to have a method for forming pouches which are easy to open, yet can be repeatedly reclosed and reopened.

SUMMARY OF THE INVENTION

According to the present invention, there is provided a pouch formed of laminated sheets heat-sealed along their side, top and bottom edges, with a fastener sealed between the laminated sheets, and a heat-sealed upper portion above the fastener, characterized in that the pouch can be sealed with wet contents and withstands retort temperatures and pressures generated without bursting.

In another embodiment, the pouch constructed in accordance with the present invention, is characterized in that at least one laser-scored tear line is provided on each sheet in registration with a corresponding laser scored tear line on the opposing sheet, the score lines being located between the top edge and the fastener and extending substantially between the side edges.

Alternatively, a pouch is formed by folding over in half and sealing a single sheet of laminate The sheet may have a small flap at one end thereof, the flap permitting formation of a gusset to serve as a base of a stand-up pouch.

As an additional alternative, a long roll of laminate has adhesively positioned thereon and adjacent to one long edge thereof a strip of fastener of equal length. The laminate is then folded on itself along its longitudinal centerline to form two leafs and a gusset is formed by the inward folding up and in of the fold line in between the leafs. The bottom, gusseted end is then heat-sealed and the sides and top are then repetitively and sequentially heat-sealed and cooled in accordance with the inventive process described in further detail hereinbelow. The laser score lines can be applied in accordance with this third alternate embodiment either before the first folding of the laminate or after the final welding of the sides and top edge portion. According to one embodiment, the distance between the laser-scored tear line and the fastener is between about 5–30 mm.

For purposes of clarity it helps to consider the retort pouch as divided by the fastener into two sections: i.e. a storage section, containing the desired contents of the pouch, nominally below the fastener, between the fastener and the bottom side, and an opening section, used for facilitating the reclosing and the reopening of the pouch, nominally above the fastener, between the fastener and the top side.

While most pouches are rectangular in shape, pouches made in accordance with the present invention could be triangular, circular, oval or of other shapes. Edge terms used herein are merely to facilitate the presentation of this invention without intending to limit it in any way to shapes having a clearly defined top, bottom and two sides.

There is also provided in accordance with the present invention an exemplary method for forming a stand-up pouch including forming a pouch from two laminated sheets, heat-sealing a bottom portion with a gusset between the two sheets, heat-sealing the two sheets along their side edges together with a fastener positioned and sealed between the two side edges of the laminated sheets, and laser scoring the two laminated sheets to form a single tear line on each sheet, the tear lines being in registration with one another.

Alternatively, an exemplary method for forming a pouch comprises the steps of folding a single sheet over in half, thereby forming two leaves, inserting a zipper, heat-sealing and laser scoring the leaf surface above the zipper to form at least one tear line on each leaf, said tear lines being in registration with one another.

According to yet another exemplary embodiment of the invention, the two sheets are scored with a laser on the inside surface of the pouch before the step of heat-sealing a bottom portion.

According to still another exemplary embodiment of the invention, the two sheets are simultaneously scored in registration by a laser on the outside surface of the pouch after the step of heat-sealing the two sheets along their bottom edges, or after heat-sealing of the sides.

According to yet a further embodiment of the invention, the shoots are scored both on their inner and on their outer surfaces.

According to yet another exemplary embodiment of the invention, both inner and outer surfaces are scored simultaneously by a single laser.

According to a preferred exemplary embodiment of the invention, the periphery of the pouch is heat-sealed in three stages, each at a successively slightly, higher temperature, and then cooled in two stages.

There is also provided in accordance with the present invention a machine for producing pouches, the machine including a web supply unit, a pouch forming unit, a fastener insertion unit, a longitudinal sealing unit, a servo drive unit for advancing the web from unit to unit, and a transverse sealing unit including at least one heat-sealing bar and at least one cooling bar, characterized in that the machine further includes at least one laser scoring system including preferably a $CO_2$ laser mounted adjacent the cooling bars, and mirrors and other optics arranged as is known and necessary to focus the $CO_2$ laser on respective first and second webs forming a pouch in registration with one another, so as to form a laser-scored tear line.

Laser, mirrors and optical elements can also be provided to form laser score lines on both inner and outer web surfaces simultaneously.

According to an exemplary embodiment of the invention, the machine includes three heat-sealing bars, each at a successively slightly higher temperature and pressure than the previous bar, and two cooling bars.

Further according to a preferred embodiment, the servo drive includes a roller having an annular groove arranged in registration with fasteners on partially formed pouches.

BRIEF DESCRIPTION OF THE DRAWINGS

The present invention will be further understood and appreciated from the following detailed description taken in conjunction with the drawings in which:

FIG. 10 is a detail view of the laser scoring unit according to one embodiment of the invention;

FIG. 11 is a detail view of the laser scoring unit according to another embodiment of the invention.

DETAILED DESCRIPTION OF THE INVENTION

The present invention relates to pouches for holding a variety of products, including dry and wet retort food products. In particular, the pouches of the present invention include a fastener, to permit multiple reopening and secure reclosing of the pouch, and, in a preferred embodiment, a laser-scored tear line, to provide precise and easy opening of the package. The fasteners used could be zipper fasteners, for example of the rib and trough type, or any other type of repetitively reclosable fasteners suitable for use in retort pouch conditions. It is a particular feature of the invention that the pouches are suitable for use with liquid or wet retort foods, typically having moisture contents of about 5% or more, and could be made as stand-up pouches. Surprisingly, it was found that score lines made on inner surface of a pouch do not lower the pouch's strength during the retort process as much as do score lines made on external surfaces, inner score lines having therefore an advantage over outer score lines.

Figure 1:
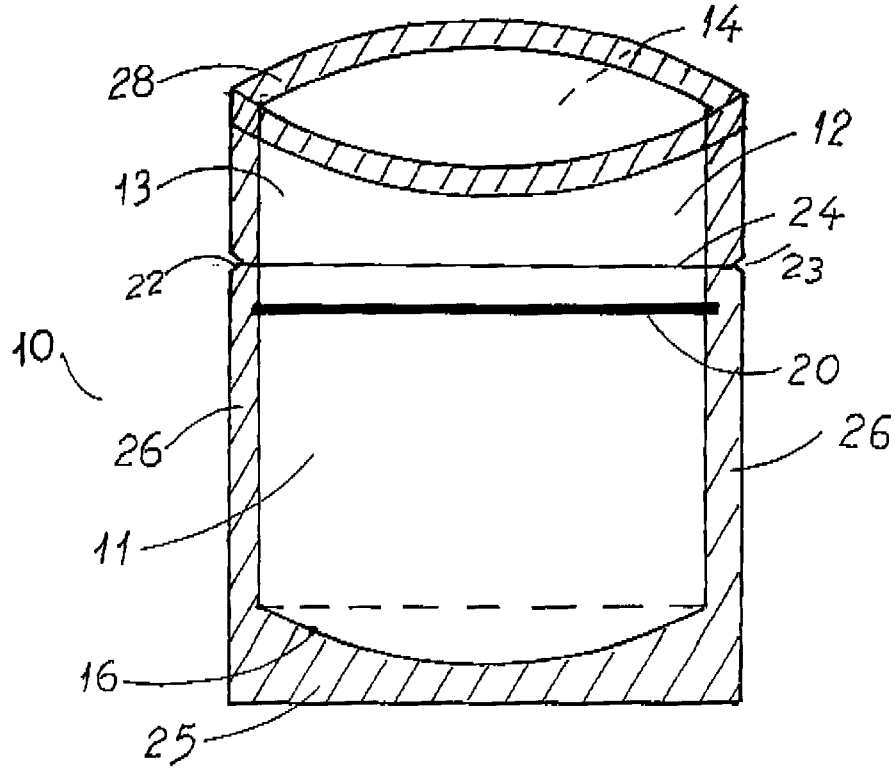
FIG. 1 is a schematic illustration of a pouch constructed and operative in accordance with two embodiments of the invention.
Figure 4:
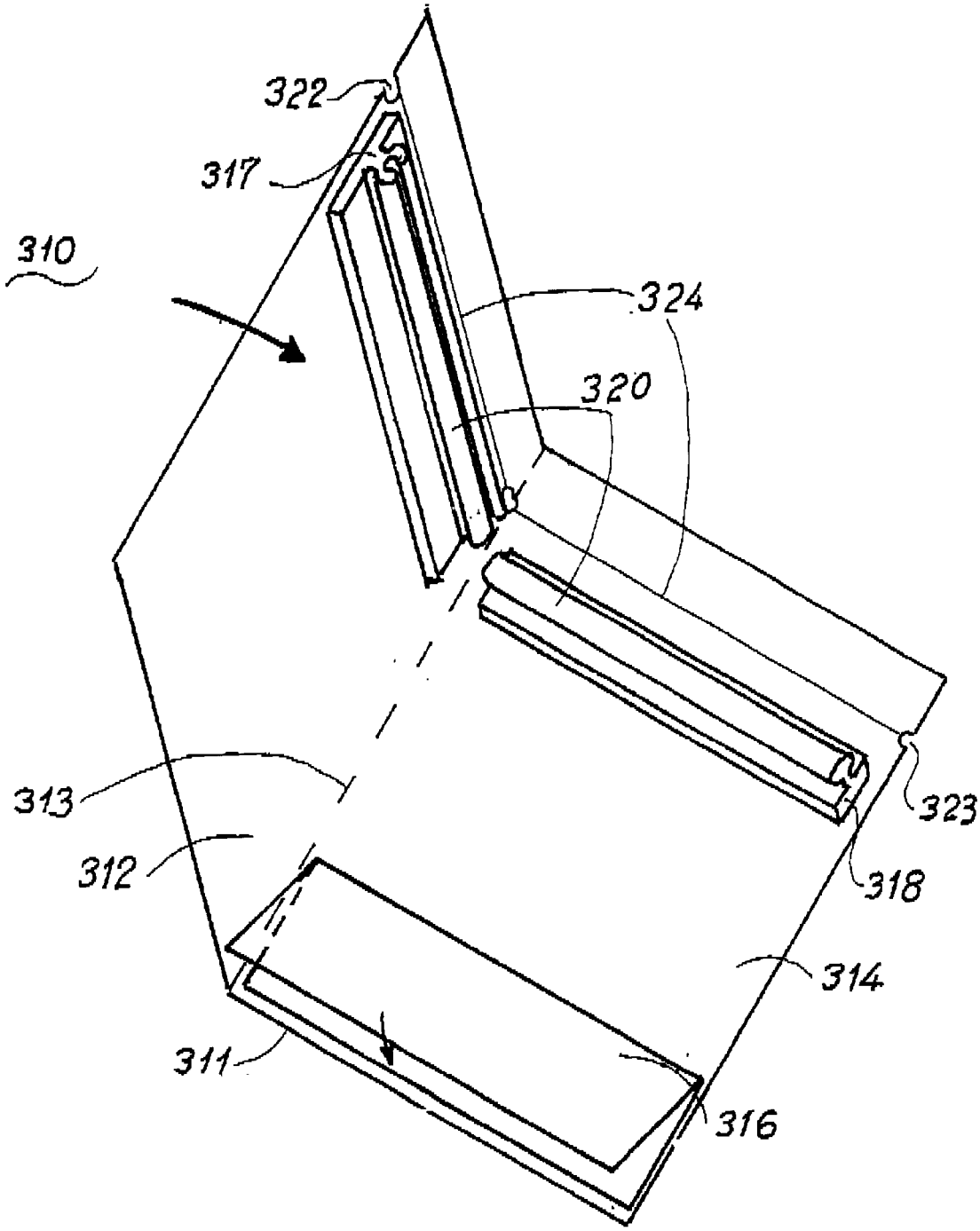
FIG. 4 is a schematic illustration of still another embodiment of a pouch constructed and operative in accordance with still another embodiment of the invention.

Referring now to FIG. 1, there is shown a schematic illustration of a pouch 10 constructed and operative in accordance with one embodiment of the invention. Pouch 10 is formed of a laminated material, and includes a front panel 12, a back panel 14, and may include a base gusset 16. The laminated material can include a number of different layers and, for retort food packaging purposes, generally includes a polyester layer, an aluminum or transparent (PVDC or polyvinyl dichloride) high barrier film layer (a barrier to air, humidity, and optionally, light), a BiOriented Nylon (BoNyl) or polyester ("PET") layer, and a cast polypropylene ("CPP") innermost layer for heat-sealing. The pouch is heat-sealed along its top, side and bottom edges in accordance with the present invention as will be further described hereinbelow. A fastener 20, including a rib and a trough, shown in detail in FIG. 4, is provided between the front and back panels, extending in the transverse direction of the pouch, substantially from one heat-sealed side to the other heat-sealed side of the pouch.

It should be noted that zipper fastener 20 divides the pouch into two sections:

- a storage section 11, containing the desired contents of the pouch, normally located below fastener 20, between fastener 20 and the bottom side 25 or base gusset 16, and
- an opening section 13, used for facilitating the reclosing and the reopening of the pouch, normally located above fastener 20, between fastener 20 and the top side 28.

While most pouches are rectangular in shape, having top, bottom and two sides and having seams along these sides, other pouch shapes have various advantages. Thus pouches could be triangular, circular, oval or of other shapes. However, by defining all pouches as having two sections, it is understood that side terms used herein are intended to facilitate the presentation of this invention without in any way limiting it to shapes having a clearly defined top, bottom and two sides.

Above fastener 20, at the side edges 26 of the pouch, at least one V-notch 22, but preferably two opposing V-notches 22, 23 are formed. According to the present invention, a laser-scored tear line 24 is provided on each of front and back panels 12 and 14, in registration with one another, extending between V-notches 22, 23. Preferably, the distance between laser-scored tear line 24 and fastener 20 is about 5–30 mm, and more preferably from about 10–20 mm. The minimum is due to the need to leave grippable edges to be grasped by a user when opening the fastener. The maximum is recommended for economic reasons, since a greater distance would require a longer package, though it is contemplated that a longer distance could be desirable and therefore 18 not to be excluded. V-notches 22, 23 and laser scored tear line 24 are preferably fonned as close as possible to the top heat-sealed edge of the pouch, i.e., about 2 mm., though it is contemplated here as well that a longer distance could be useful for various purposes and is not to be excluded. This serves to provide an optimum size for the pouch, as well as to ensure the directionallty of the tear.

Figure 2:
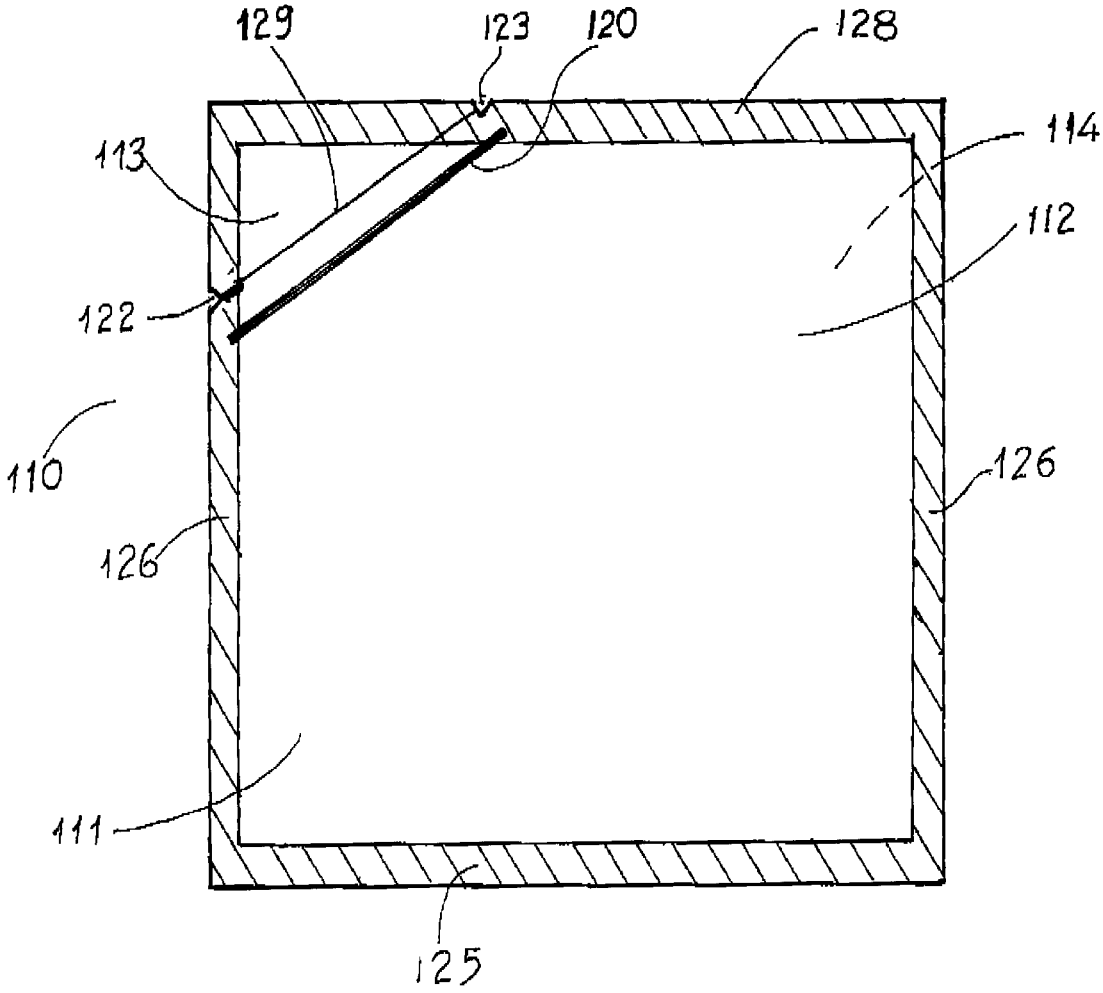
FIG. 2 is a schematic illustration of another embodiment of a pouch constructed and operative in accordance with another embodiment of the invention.

Referring now to FIG. 2, there is shown a schematic illustration of a pouch 110 constructed and operative in accordance with another embodiment of the invention. The numbers of the various parts of the pouch shown in FIG. 2 are increased by 100 compared to the numbers of the corresponding parts in FIG. 1. Fastener 120 is provided between the front and back panels, extending obliquely on the pouch, substantially from one side heat-sealed seam to the top heat-sealed seam of the pouch. After tearing, the tear becomes the circumference of orifice 129, serving as a convenient spout. The embodiment of FIG. 2 also provides for a better utilization of the packaging material.

Figure 3:
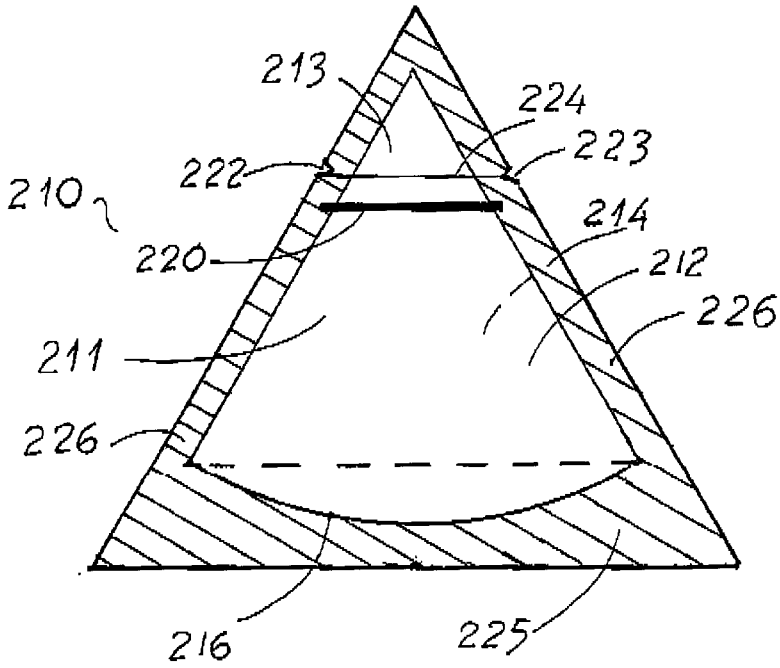
FIG. 3 is a schematic illustration of yet another embodiment of a pouch constructed and operative in accordance with yet another embodiment of the invention.

Referring now to FIG. 3, there is shown a schematic illustration of a pouch 210 constructed and operative in accordance with yet another embodiment of the invention. The numbers of the various parts of the pouch shown in FIG. 3 are increased by 200 compared to the numbers of the corresponding parts in FIG. 1.

Figure 12:
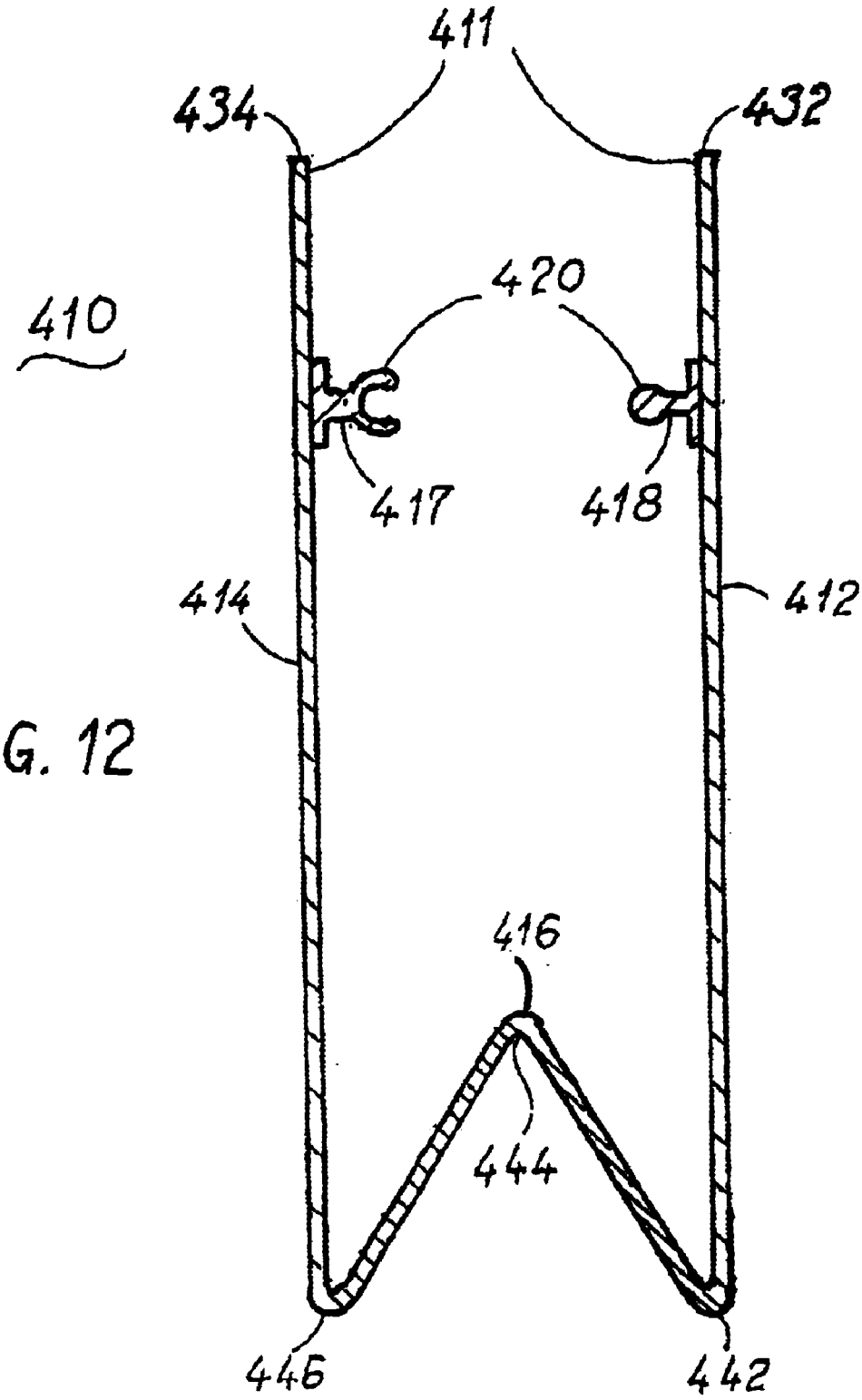
FIG. 12 is a cross-sectional view of a web and fastener arrangement which can be welded to construct a pouch in accordance with still another exemplary embodiment of the present invention.

Referring now to FIG. 4, there is shown a schematic illustration of a pouch 310, during an intermediate manufacturing stage, constructed and operative in accordance with still another embodiment of the invention. The numbers of the various parts of the pouch shown in FIG. 4 are increased by 300 compared to the numbers of the corresponding parts in FIG. 1. A sheet 311 is folded in two along fold line 313 to form a front leaf 312 and a rear leaf 314, and the rib part 318 of rib and trough zipper fastener 320 is sealed to one leaf while the trough part 317 of fastener 320 is sealed to the other leaf. Fastener 320 could be assembled in more than one orientation, i.e. parallel to fold 313, inclined to it as shown in FIG. 2, or perpendicular to it Referring now to FIG. 12, there is shown a schematic illustration of a cross sectional view of a pouch 410, during an intermediate manufacturing stage, constructed and operative in accordance with still yet another embodiment of the invention. The numbers of the various parts of the pouch shown in FIG. 12 are increased by 400 compared to the numbers of the corresponding parts in FIG. 1. A rectangular sheet of a laminated material 411 having two ends 432, 434, is folded in four along three fold lines 442, 444 and 440 to form a front leaf 412, spaced between one end 432 of sheet 411 and fold 442, a rear leaf 414 spaced between the other end 434 of sheet 411 and fold 446, and a gusset 416 spaced between folds 442 and 446, and including fold 444. The rib part 418 of rib and trough zipper fastener 420 is sealed to one leaf while the trough part 417 of fastener 420 is sealed to the other leaf. Fastener 420 could be assembled in more than one orientation, i.e. parallel to folds 442, 444, 440 or inclined to them, as shown in FIG. 2.

It is a particular feature of the present invention that the use of laser scoring to provide a tear line ensures that the Al layer (or alternate barrier layer, e.g. PVDC) in the laminate remains intact without any pinholes created during the scoring process. This permits a shelf life of as much as three yours for retort processed products in the pouch. Thus, the need to preserve the protective barrier layer intact is critical, particularly in pouches for which a long shelf life is desired.

In order to withstand the pressures generated inside the pouch during the retort process, it is necessary to form the laser-scored tear lines in such a manner that the mechanical characteristics of the laminate will be retained and the aluminum or other protective barrier layer remains intact. Since the two strongest layers in conventionally used laminates are the PET and BONyl layers, the scoring of one of these two layers provides relatively easy tearing of the laminate.

Figure 5:
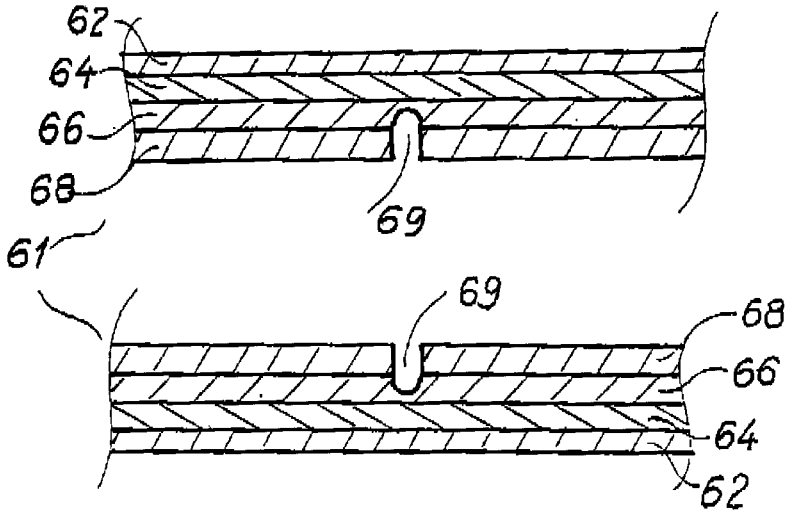
FIGS. 5, 6 and 7 are cross-sectional schematic views of laminate structures which are particularly suitable for use in the present invention.

Three non-limiting examples of suitable laminate compositions are described with reference to FIGS. 5–7. The first, shown in FIG. 5, includes a PET layer 62, an Al layer 64, a BONyl layer 66, and a CPP layer 68, this laminate 61 being henceforth called PABC. For this composition, the laser treatment is carried out from the direction of the CPP, i.e., on the inward facing surfaces of the finished pouch, since the CPP layer is the heat-sealing cohesive layer. The laser is placed above the slitter, and the webs are scored before assembly into pouches. The laser may cut partially into the BONYL layer 66, although this treatment preserves both the outer PET 62 and inner Al layer 64. It has surprisingly been found that, if the PET layer 62 in this embodiment is provided in a thickness of about 19 microns the score area is not severely weakened and tolerates the retort process with a failure rate as low as 0.01%. Typically, the thickness of the CPP layer can range from about 60 microns to about 100 microns.

Figure 6:
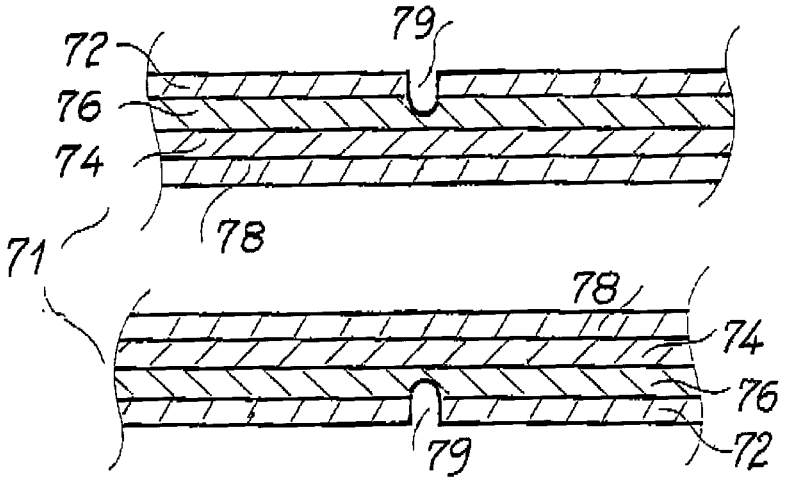

A second exemplary embodiment of laminate 71, shown in FIG. 6, includes a PET layer 72, a BONyl layer 76, an Al layer 74, and a CPP layer 78 (PBAC). When PBAC 18 used, the laser treatment is carried out on the outer side of the pouch, and may be accomplished after heat-sealing the sides of the pouch. The lasor scores through the PET layer 72 and part of the BONyl layer 76. Since the Al 76 is reflective, it tends not to be damaged by the laser scoring, even if it is inadvertently exposed to the laser beams. In this way, it is possible to provide a very thin laser-scored tear line, on the order of a few microns in width. This provides directionality and ease of tearing through both "problem" layers of the pouch. At the same time, the mechanical characteristics of the laminate 71 are preserved.

Figure 7:
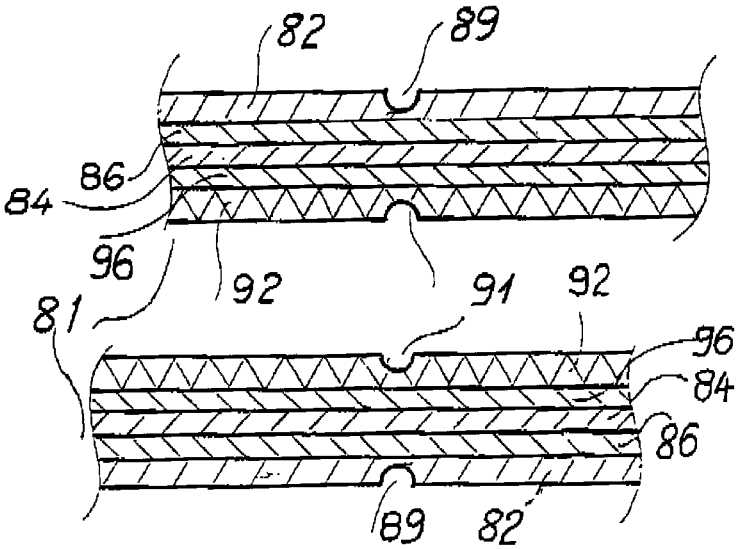

A third laminate composition 81, PBABC, shown in FIG. 7, includes an outer PET layer 82, a BONYL layer 86 (the directional or oriented nylon film), an Al layer 84 (for air and light barrier), another BONyl layer 96 and an inner CPP layer 92. Two score lines 89 and 91 are shown provided on outer surfaces PET layer 82 and an inner surface CPP layer 92, respectively. Usually, the PET layer is provided having a thickness of about 12 microns, however, for the present embodiment, due to the added laser score line 96, reliance on the structural properties of the PET is somewhat increased and accordingly its thickness may need to be increased as much as 50%.

It will be appreciated that, alternatively, a transparent pouch can be provided. In this case, the laminate includes a high barrier film, such as a PVDC or PET-coated layer, instead of an aluminum layer.

Figure 8:
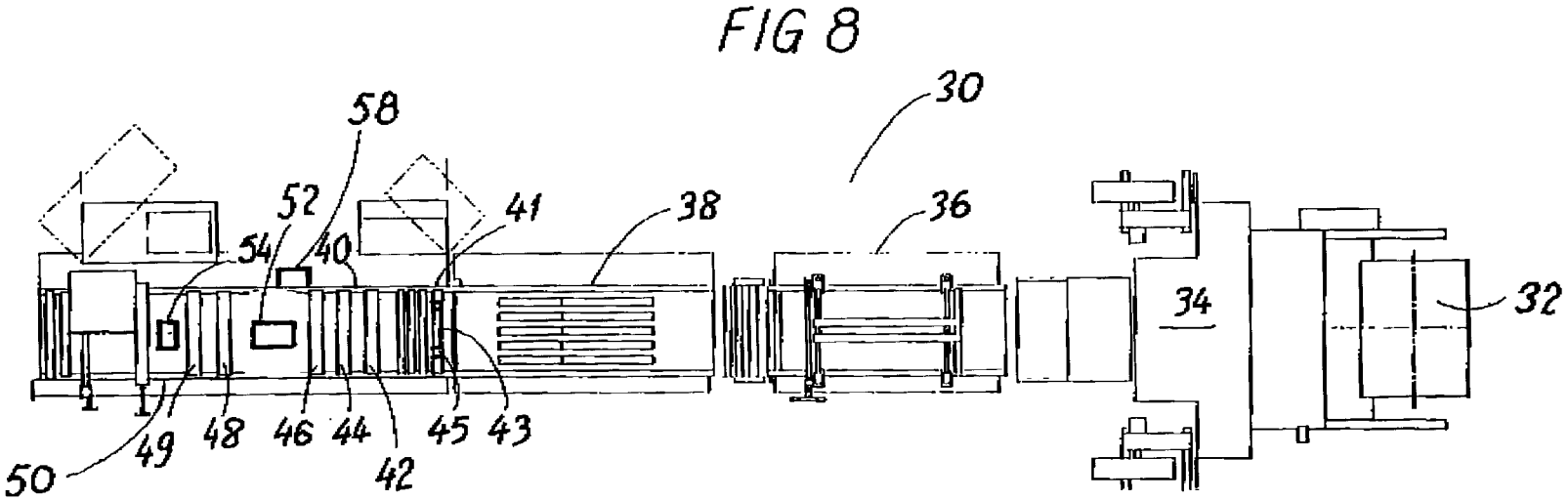
FIG. 8 is a schematic top view of a machine for forming pouches according to one embodiment of the present invention.

Referring now to FIG. 8, there 18 shown a schematic perspective view of a machine 30 for forming pouches according to one embodiment of the present invention. Machine 30 includes a web supply 32 fed into a pouch forming unit 34 which splits the web into two half webs, one to form the front panels of pouches and the other to form the back panels of the pouches, and superimposes one half web onto the other. From pouch forming unit 34, the superimposed half webs are fed into a fastener insertion unit 36, wherein fasteners are inserted between the superimposed half webs a predetermined distance apart. The superimposed halt webs now pace through a longitudinal scaling unit 38, wherein the bottom portion of the pouch is sealed, as shown in the prior art, for example the pouch making machines of Kapak Corporation, Minnesota, USA, and of Totani Giken Kegyo Co., Ltd., of Kyoto, Japan. These machines can be modified, as described hereinbelow, to manufacture pouches according to the present invention.

The fastener is sealed in place by means of a heat-sealing bar at relatively low temperature but under high mechanical pressure. This provides an irreversible heat-seal of the fastener zipper to the laminate.

The partially formed pouches are now fed via a servo drive 41 into a transverse sealing unit 40 for sealing the side seams of the pouches. It is a particular feature of the present invention that servo drive 41 includes a roller 43 having an annular groove 45 arranged in registration with the fasteners on the partially formed pouches. In this way, the webs can be advanced from station to station, without pressing on or damaging the fasteners.

Transverse sealing unit 40 provides a highly resistant sealing of the pouches, and it is assembled specifically for the invention in the following way. Transverse sealing unit 40 includes three transverse heat-seaung bars 42, 44, 46, each at a slightly higher temperature and pressure than the previous heat-sealing bar. The temperatures generally range from about 190° C. in heat-sealing bar 42 to about 240° C. in heat-sealing bar 46, depending on the particular composition and/or thickness of the laminate. The pressure of the heat-sealing bars can be adjusted, for example by adjustment screws. Generally speaking, increased pressure reduces the temperature requirement for the applied heat.

Heat-sealing bars 42, 44 and 46 are arranged to sequentially seal identical seams on both sides of the pouches. Preferably, first and third heat-sealing bare 42 and 46 heat from above, while second heat-sealing bar 44 heats from below, the anvil portion of the sealing bar being cooler and covered with silicon tape. Although the preferred embodiment alternates the direction from which the heat is applied, the heat-sealing bars could all be applied on the same side. For conventional pouches, generally only two sealing bars are utilized, and they are heated to the same temperature, not at incrementally higher temperatures per the present invention.

Following the heat-sealing stage, the pouches pass through a cooling stage. According to the present invention, instead of a single cooling bar, as in conventional devices, two cooling bars 48 and 49 at about 20° C. are provided for sequential cooling of the sealed lines on both sides of the pouches. This sequential heat treatment through three stages at gradually rising temperatures and pressures, followed by two cooling stages strengthens the heat seam while preserving the flexibility of the laminate, unlike conventional machines wherein if the temperature is too high, the laminate loses its flexibility, while if the temperature is too low, the seam is poor. In addition, due to the use of two special pressure units in the fastener sealing stage, which create a high quality heat seam sufficiently strong to withstand retort temperatures and pressures, the incorporation of a fastener in the present invention weakens the pouch to a lesser degree than in conventional pouches.

Figure 9:
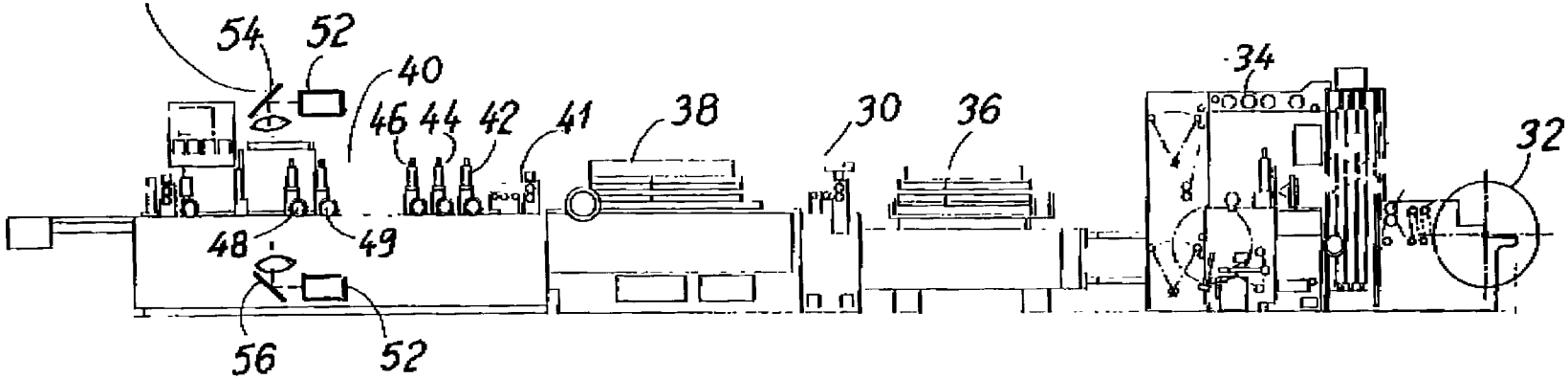
FIG. 9 is a side elevational view of the machine of FIG. 8.

According to one embodiment of the invention, illustrated in FIG. 9, the pouches, already seamed on three edges, are passed through a laser scoring station 50. The use of a $CO_2$ laser, whose beam does not damage aluminum, permits the safe use of laser scoring in laminates for pouches destined for retort treatment sterilization.

$CO_2$ laser 52 is mounted adjacent the pouch forming machine, either after sealing of the bottom of the pouch or after heat-scaling of The aides. A first mirror 64, with associated optics, is provided above the production line for reflecting the laser rays from laser 52 onto a point on the top or front panel 12 of the pouch on the production line. A second mirror 56, with associated optics, is provided beneath the production line for reflecting the laser rays from laser 52 onto a point on the bottom or back panel 14 of the pouch, substantially in registration with the point on the front panel. By adjusting the mirrors 54 and 56, it is possible to provide a high degree of precision of scoring, so as to substantially facilitate the tearing of the finished pouch.

It is a particular feature of the invention that a single laser can be utilized to provide simultaneously two precisely oriented score lines in registration with one another on the front and back panels of a pouch. The laser is activated by means of an electric eye 58 which identifies an eye mark printed on the plastic web, as known.

This method provides a secure seal for pouches of many small and medium commercially required sizes (up to about 500 cc.) For larger pouches which are to be sterilized by retort, it is preferable to utilize an alternative laser scoring method, illustrated in FIG. 10. In this embodiment, laser scoring of the pouches is accomplished in the slitter, before the web enters the pouch forming machine. A($CO_2$) laser 60, suitable for scoring of the desired layers, is mounted adjacent the slitter. A plurality of mirrors or other optical components are provided to focus the laser beam on the desired points on the web, along the heat-sealing surface that will eventually be the inside of the, finished pouch. In one embodiment illustrated in FIG. 10, a first mirror 70 is mounted opposite laser 60. Second and third mirrors 72 and 74 are provided to reflect the beam above the production line. A fourth mirror 76, which is a splitter, is provided to divide the beam into, two parts, one part being reflected downwards onto the web, and the other part passing through mirror 76 to a fifth mirror 78, which reflects the beam downwards onto the web an equal distance from the canter (slitting) line as mirror 76. In this way, two parallel scoring lines are provided in the web, on the side which will form the inside of the final pouch, such that the two lines are substantially in registration with one another.

In another embodiment, shown schematically in FIG. 11, laser score lines are provided simultaneously in registration in both the inner and the outer part of the web before its folding or slitting by laser scoring unit 130, including laser unit 160. Laser 160 emits laser beam 162, reaching beam splitter 170, beam splitter 170 splitting beam 162 into two beams 164 and 166. Beam 164 illuminates and scores one side of web material 134, continuously fed by web supply unit 132, in a desired location. Beam 166 is reflected by any necessary number of mirrors, shown here by way of illustration only as mirrors 172, 174 and 176, to illuminate and score the other side of web material 134 in registration with the score effected by beam 164. The web material is then fed to other units, as shown hereinabove.

It should be understood that by using the disclosed method and apparatus, it is now possible [a] to make pouches suitable for wet retort [b] which have a recloseable fastener. Prior art methods could not yield a pouch having a zipper which was sufficiently reliable to be mass-produced and marketed for wet retort. By the present invention, it is possible to achieve reliability rates as high as 99.99%, as measured by the number of sealed pouches which burst while undergoing retort processing out of the total number of pouches processed.

It will be understood that the exemplary embodiments described hereinabove may be altered or modified by one skilled in the art. It should be appreciated that such alterations and modifications can be made without departing from the scope of the invention, the breadth and scope of which should be determined solely by reference to the claims which follow, the description hereinabove merely being intended to provide guidance by way of non-limiting examples of ways in which the invention may be applied.

I claim:

1. A retort pouch, for holding wet content food, said pouch comprising at least two opposed sheets of retort-resistant laminate material, each sheet constructed of a plurality of layers, including an outermost polyester layer, a barrier film layer, a burst-resistant layer and an innermost layer for heat sealing, said sheets being heat-sealed together along the outer edges thereof, said sheets having a recloseable fastener attached therebetween, said sheets each being provided with a laser score line on the inner surface of said burst-resistant layer while said innermost heat sealing layer remains intact preventing the penetration of food into the laminate material so as to preserve shelf-life, without detrimentally affecting the mechanical properties of said pouch, said score lines being opposed to and in registration with one another for easy tearing of the pouch along said score lines, said pouch being burst-resistant to retort processing when filled with wet contents and sealed.

2. A retort pouch according to claim 1, where said pouch is a stand up pouch.

3. A retort pouch according to claim 1, wherein said barrier film layer is made of Aluminum foil.

4. A retort pouch, for holding wet content food, said pouch comprising at least two opposed sheets of retort-resistant laminate material, each sheet constructed of a plurality of layers, including an outermost polyester layer, a barrier film layer, a burst-resistant layer and an innermost layer for heat sealing, said sheets being heat-sealed together along the outer edges thereof, said sheets each being provided with a laser score line on the inner surface of said burst-resistant layer while said innermost heat sealing layer remains intact preventing the penetration of food into the laminate material so as to preserve shelf-life, without detrimentally affecting the mechanical properties of said pouch, said score lines being opposed to and in registration with one another and parallel with one of said outer edges for easy tearing of the pouch along said score lines, said pouch being burst-resistant to retort processing when filled with wet contents and sealed.

5. A retort pouch according to claim 4, wherein said pouch is a stand up pouch.

6. A retort pouch according to claim 4, wherein said score lines are additionally on the outer surfaces of said sheets.

7. A stand-up retort pouch, for holding wet content food, said pouch comprising at least two opposed sheets of retort-resistant laminate material and a bottom gusset, each sheet constructed of a plurality of layers, including an outermost polyester layer, a barrier film layer, a burst-resistant layer and an innermost layer for heat sealing, and further having a recloseable fastener between said opposing sheet surfaces thereof, said recloseable fastener extending from a first side outer edge to an opposing second side outer edge and adjacent to at least one outer edge, said sheet surfaces each having a laser score line on the inner surface of said burst-resistant layer while said innermost heat sealing layer remains intact preventing the penetration of food into the laminate material so as to preserve shelf-life, without detrimentally affecting the mechanical properties of said pouch, said laser score lines provided in registration with one another and parallel with said recloseable fastener, said sheets being heat-sealed together along the top and side outer edges thereof and together with said gusset at a bottom edge thereof, said pouch being burst-resistant when sealed after first being filled with wet contents and subsequently being subjected to retort processing.

8. The pouch according to claim 7, wherein said laser scored tear line is between an outer edge and said recloseable fastener and is formed less than 20 mm. from said heat-sealed outer edge.

* * * * *